US010415284B2

(12) United States Patent
Kim

(10) Patent No.: US 10,415,284 B2
(45) Date of Patent: Sep. 17, 2019

(54) REFRIGERATOR AND HINGE DEVICE FOR DOOR OF REFRIGERATOR

(71) Applicant: Dongbu Daewoo Electronics Corporation, Seoul (KR)

(72) Inventor: Tae Jin Kim, Incheon (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 0 days.

(21) Appl. No.: 15/920,225

(22) Filed: Mar. 13, 2018

(65) Prior Publication Data

US 2018/0298657 A1 Oct. 18, 2018

(30) Foreign Application Priority Data

Apr. 13, 2017 (KR) ..... 10-2017-0047911

(51) Int. Cl.
*E05D 7/12* (2006.01)
*E05D 3/02* (2006.01)
(Continued)

(52) U.S. Cl.
CPC ..... *E05D 7/12* (2013.01); *E05D 3/02* (2013.01); *E05D 5/04* (2013.01); *E05D 5/12* (2013.01);
(Continued)

(58) Field of Classification Search
CPC ..... E05D 7/12; E05D 2005/102; E05D 2005/108; E05D 2007/126; E05Y 2900/31; F25D 2323/024
(Continued)

(56) References Cited

U.S. PATENT DOCUMENTS 1,863,323 A * 6/1932 Berne ..... E05D 7/12 16/256
4,850,080 A * 7/1989 Rock ..... E05D 7/0407 16/236

(Continued)

FOREIGN PATENT DOCUMENTS

GB 1370256 A * 10/1974 ..... E05D 5/127
KR 101586588 B1 2/2016
WO WO-2009043696 A1 * 4/2009 ..... E05D 5/065

OTHER PUBLICATIONS

Do Man Sung; "Refrigerator and Method for Manufacturing Thereof"; Bibliographic Data of KR101586588(B1); Feb. 2, 2016; http://worldwide.espacenet.com.

*Primary Examiner* — Andrew M Roersma
(74) *Attorney, Agent, or Firm* — Andrew D. Fortney; Central California IP Group, P.C.

(57) ABSTRACT

The present disclosure relates to a refrigerator and a hinge for a door of the refrigerator. In accordance with an aspect of the disclosure, there may be provided a refrigerator, including a main body having a storage space capable of storing food, a door configured to selectively open and close or shield the storage space of the main body, and a hinge rotatably fixing the door to the main body, wherein the hinge includes a lower hinge plate fixed to the main body, an upper hinge plate connected to the lower hinge plate, coupled to the door and including a pivot configured to enable the door to rotate, and a connection part connecting the upper hinge plate and the lower hinge plate and enabling the upper hinge to rotate with respect to the lower hinge plate.

19 Claims, 6 Drawing Sheets

(51) Int. Cl.

| | |
|---|---|
| ***E05D 5/04*** | (2006.01) |
| ***F25D 23/02*** | (2006.01) |
| ***E05D 5/12*** | (2006.01) |
| ***E05D 7/10*** | (2006.01) |
| *E05D 5/10* | (2006.01) |

(52) U.S. Cl.
CPC ..... *E05D 7/10* (2013.01); *E05D 7/1022* (2013.01); *F25D 23/028* (2013.01); *E05D 2005/102* (2013.01); *E05D 2005/108* (2013.01); *E05D 2007/126* (2013.01); *E05Y 2900/31* (2013.01); *F25D 2323/024* (2013.01)

(58) Field of Classification Search
USPC ..... 16/254, 257, 258, 267, 268
See application file for complete search history.

(56) References Cited

U.S. PATENT DOCUMENTS

| | | | | |
|---|---|---|---|---|
| 5,175,891 | A * | 1/1993 | Ohshima | A47K 13/26 16/324 |
| 6,070,300 | A * | 6/2000 | Shin | E05D 7/1044 16/382 |
| 7,178,199 | B2 * | 2/2007 | Kashiwaguma | E05D 7/125 16/258 |
| 9,470,450 | B2 | 10/2016 | Do | |
| 9,885,514 | B2 * | 2/2018 | Giacomini | F25D 23/028 |
| 2016/0138852 | A1 | 5/2016 | Do | |
| 2017/0159993 | A1 * | 6/2017 | Giacomini | F25D 23/028 |
| 2018/0156531 | A1 * | 6/2018 | Heisswolf | E05D 7/0423 |

* cited by examiner

REFRIGERATOR AND HINGE DEVICE FOR DOOR OF REFRIGERATOR

TECHNICAL FIELD

The present disclosure relates to a refrigerator and a hinge device for a door of the refrigerator.

BACKGROUND

A refrigerator is an apparatus enabling the low-temperature storage of food and is configured for the cold storage or freezing storage of food. To this end, the refrigerator may include a cooling apparatus in which a cooling or refrigeration cycle has been implemented. The cooling apparatus is configured so that a refrigerant therein undergoes a compression-condensation-expansion-evaporation process. Cool air is generated as the refrigerant circulates the cooling cycle. The cool air generated by the evaporator of the cooling apparatus is supplied to the storage space of the refrigerator. Food within the refrigerator may be stored under a required temperature condition as the cool air supplied to the storage space of the refrigerator is circulated by convection current. In general, the main body of the refrigerator has a rectangular shape having the front open, and the inside of the main body includes a cold room and a freezing room. Furthermore, a cold room door and freezing room door for selectively closing or shielding a corresponding opening is provided at the front of the main body.

The refrigerator may be basically divided into a top-mount type in which the freezing room is above the cold room, a bottom freezer type in which the freezing room is below the cold room, and a side-by-side type in which the freezing room and the cold room are laterally adjacent to one another and partitioned depending on the location of the freezing room and the cold room.

The door of the refrigerator may be rotatably fixed to the main body by one or more hinges. Specifically, the hinge may include a plate fixed to the main body by a fastening member, such as a bolt, and a pivot extending from the plate. The pivot is inserted into a bushing in the door, so the door may rotatably move. Accordingly, if the door is separated from the main body for a reason, such as a failure of the door, a problem may arise when the door must be separated only after the hinge is fully separated from the main body using a tool.

Furthermore, if a door is reassembled onto the main body for a reason, such as the replacement of a door, the hinge must be fixed to the main body again. In this case, the hinge may not be assembled at its regular position due to the deformation of the fastening portion to the main body or the deformation of the hinge. If the door is not assembled at its regular position, a problem may occur with cool air leaking from the refrigerator. This may have a bad influence on the performance of the refrigerator.

PRIOR ART DOCUMENT

Patent Document

Patent Document: Korean Patent No. 10-1586588 (Jan. 12, 2016)

SUMMARY

In order to solve the above disadvantages, embodiments of the present disclosure provide a refrigerator and a hinge for a door of the refrigerator, where a door can be fixed at its regular position even upon reassembly.

Furthermore, embodiments of the present disclosure provide a refrigerator and a hinge for a door of the refrigerator, where the door can be separated from the refrigerator without a separate tool.

In accordance with an aspect of the present invention, there may be provided a refrigerator, including a main body having a storage space capable of storing food, a door selectively opening and shielding the storage space of the main body, and a hinge rotatably fixing the door to the main body, wherein the hinge includes a lower hinge plate fixed to the main body, an upper hinge plate connected to the lower hinge plate, coupled to the door, and including a pivot enabling the door to rotate, and a connection part connecting the upper hinge plate and the lower hinge plate and enabling the upper hinge plate to rotate with respect to the lower hinge plate.

Furthermore, the door may include a pivot insertion unit having a size corresponding to a size of the pivot, the pivot is configured to fit into the pivot insertion unit, the upper hinge plate is coupled to the door, and the door moves rotatably around the pivot.

Furthermore, the pivot may be elastically deformable, and may be elastically deformed when the pivot is in or inserted into the pivot insertion unit.

Furthermore, the pivot may have a cylindrical or pipe form, having an opening or a cut-off region along the length thereof.

Furthermore, the connection part may be at an end and/or side of the lower hinge plate farthest from the door, and the upper hinge plate overlaps the lower hinge plate when the pivot is in into the door.

Furthermore, the upper hinge plate may be hooked with or to the lower hinge plate (e.g., secured to the lower hinge plate with a hook or other, similar fastening device).

In accordance with another aspect of the present invention, there may be provided a refrigerator, including a main body having a storage space capable of storing food, a door selectively shielding and opening the storage space of the main body, and a hinge rotatably fixing the door to the main body, wherein the hinge includes a lower hinge plate fixed to the main body, a rotatable hitch member through the lower hinge plate, and an upper hinge plate having (a) an end rotatably coupled to the lower hinge plate and (b) a pivot for the door, wherein the upper hinge plate (i) overlaps the lower hinge plate and is coupled to the lower hinge plate by the hitch member in a first state, and (ii) is isolated or separated from the lower hinge plate in a second state (e.g., except at the end or side).

Furthermore, the upper hinge plate may include a hitch hole through which the hitch member can penetrate and an elastic member configured to maintain the first state (e.g., in which the hitch member is engaged with the upper hinge plate), wherein, in the first state, the hitch member is movable within the hitch hole, and the elastic member applies a force (e.g., a spring force) to the hitch member.

Furthermore, one side or end of the elastic member may be fixed to an uppermost surface of the upper hinge plate, and another side or end of the elastic member has a specific curvature, penetrates the hitch hole, and applies the force to the hitch member when the hitch member passes through the hitch hole so that the hitch member engages the upper hinge plate (e.g., forces the hitch member toward a peripheral edge of the hitch hole) in the first state.

Furthermore, the hitch member may be rotatably fixed to a hitch member fixing part extending downward from the lower hinge plate, and the main body may include a groove or depression configured to receive the hitch member fixing part.

Furthermore, the lower hinge plate may be coupled to the main body by one or more bolts, and the upper hinge plate includes one or more fastening member through-holes configured to expose each of the one or more bolts in the first state.

Furthermore, the pivot has a cylindrical or pipe form with an opening or cut-off region along a length thereof to enable elastic deformation, the pivot is elastically deformed when the pivot is in or inserted into a pivot insertion unit in the door, and/or the pivot may return to an original state after being inserted in the pivot insertion unit.

In accordance with another aspect of the present invention, there may be provided a hinge (e.g., for a door of a refrigerator), at least part of which rotates about a horizontal axis and which fixes the door to the refrigerator, the hinge including a lower hinge plate that can be fastened to a main body of the refrigerator and that includes an upward-extending hitch member, and an upper hinge plate rotatably coupled to an end and/or side of the lower hinge plate, including a hitch hole through which the hitch member couples the lower hinge plate to the upper hinge plate, and a pivot configured to be inserted into the door and around which the door rotates, the upper hinge plate being closely attached to the lower hinge plate when the hitch member couples the lower hinge plate to the upper hinge plate.

Furthermore, the hitch member may be rotatably fixed to a hitch member fixing part extending downward from the lower hinge plate, and a rotation axis of the hitch member may be under the lower hinge plate.

Furthermore, the upper hinge plate may include an elastic member configured to maintain the hitch member in an engaged state.

Furthermore, the hitch member may be movable within the hitch hole, and the hitch member and the elastic member may be configured to enable the hitch member to disengage from the hitch hole and/or the upper hinge plate.

Furthermore, one side or end of the elastic member may be fixed to the top of the upper hinge plate, another side or end of the elastic member may have a specific curvature and penetrate the hitch hole, and apply a force to the hitch member when the hitch member passes through the hitch hole so that the hitch member engages the upper hinge plate (e.g., forces the hitch member toward a peripheral edge of the hitch hole) in the first state.

Furthermore, the upper hinge plate may be rotatably connected to the end or side of the lower hinge plate farthest from the door.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

Hereinafter, specific embodiments of the present disclosure will be described in detail with reference to the drawings.

In addition, in the description of the present disclosure, the detailed description of known functions and configurations incorporated herein will be omitted if they would unnecessarily obscure features of the subject matter of the present disclosure.

Figure 1:
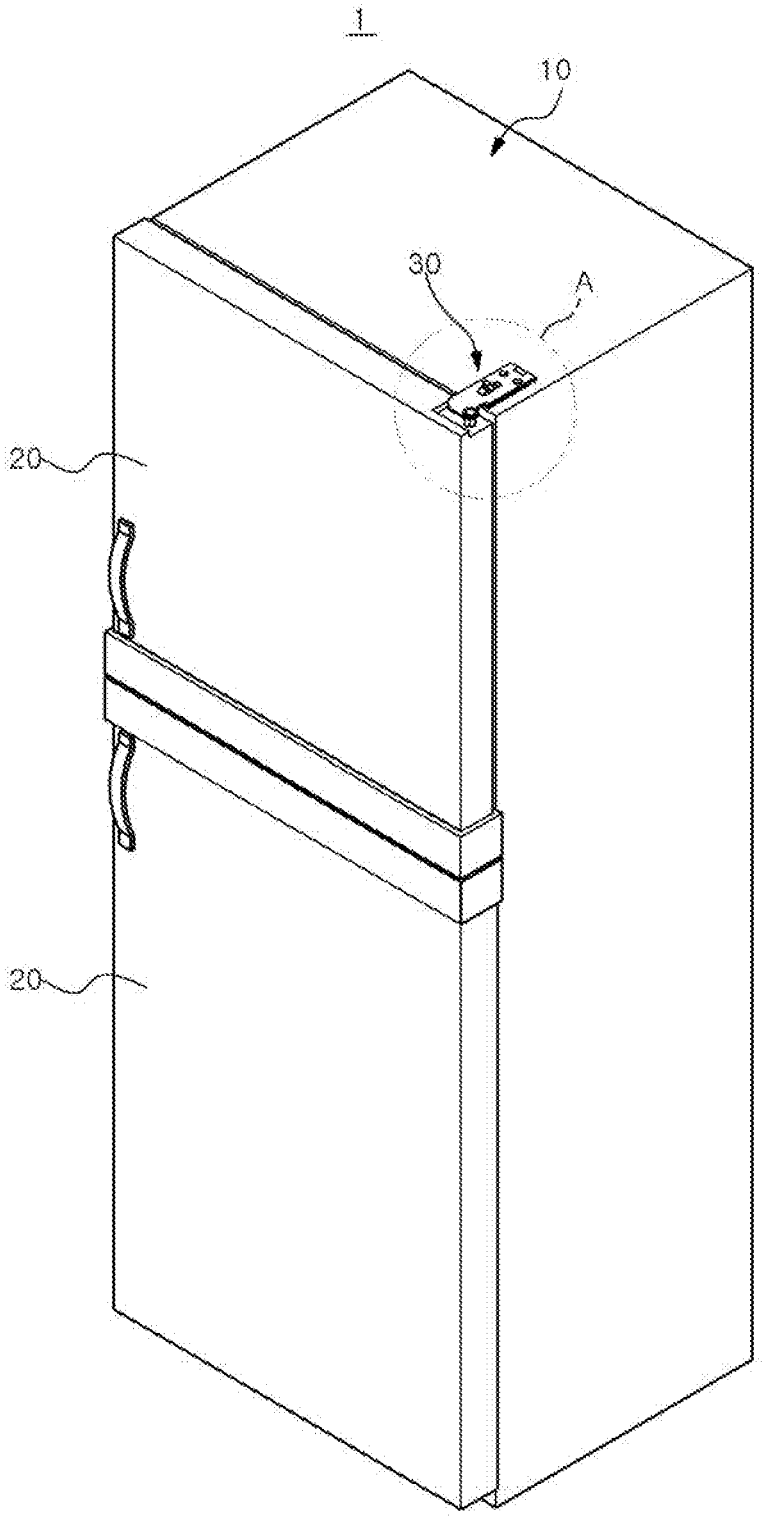
FIG. 1 is a perspective view of a refrigerator according to an embodiment of the present disclosure.
Figure 2:
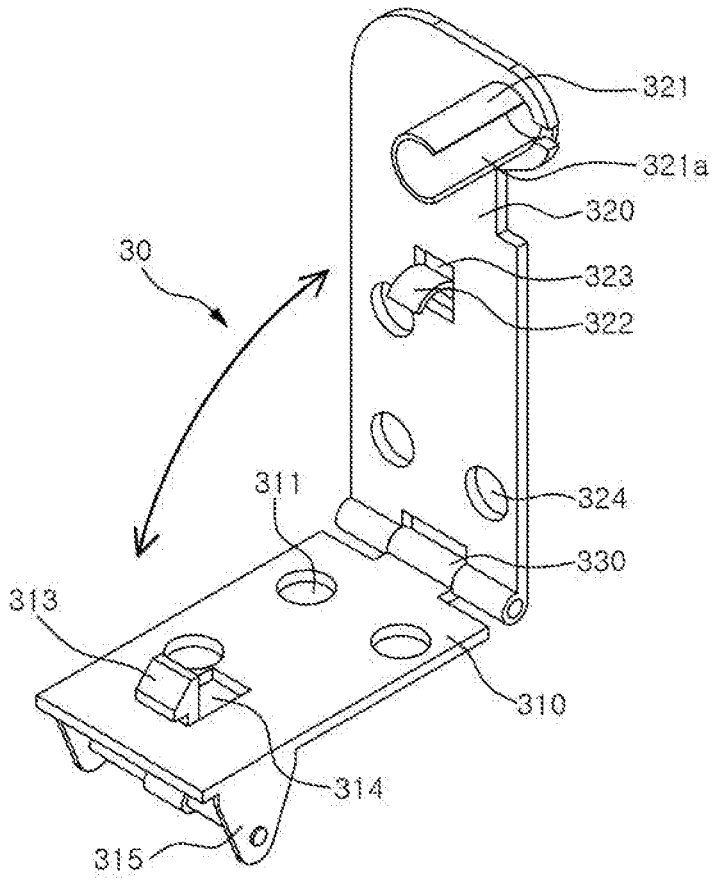
FIG. 2 is a perspective view of a hinge as shown in FIG. 1.
Figure 3:
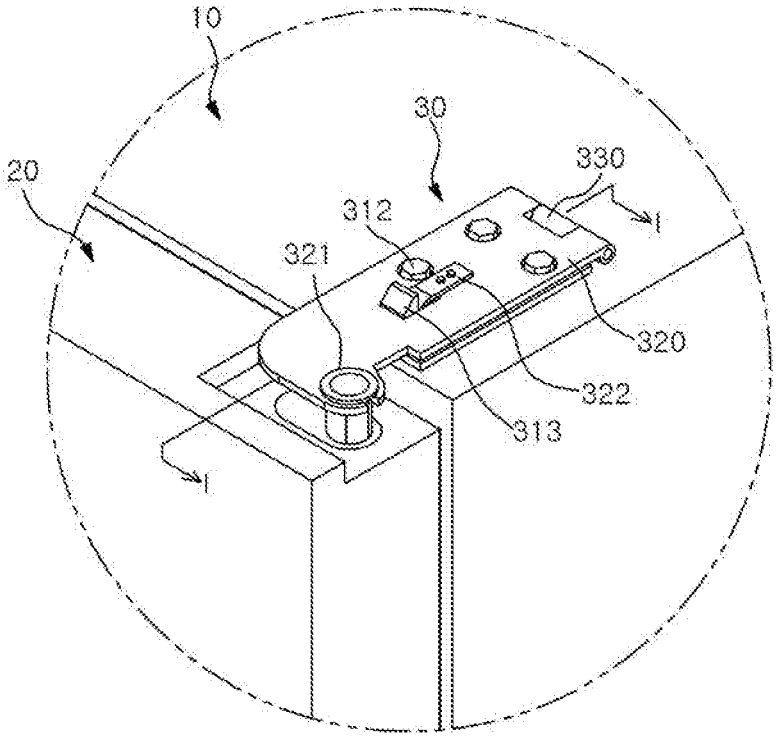
FIG. 3 is an enlarged view of a portion A in FIG. 1.
Figure 4:
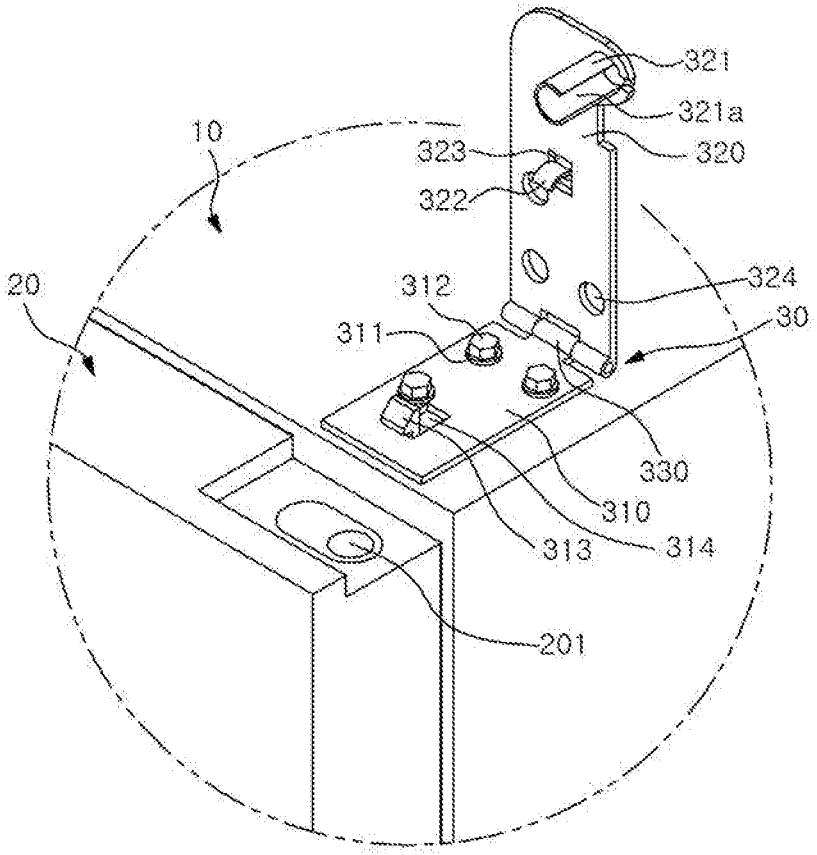
FIG. 4 is a diagram showing the hinge separated from the door shown in FIG. 1.
Figure 5:
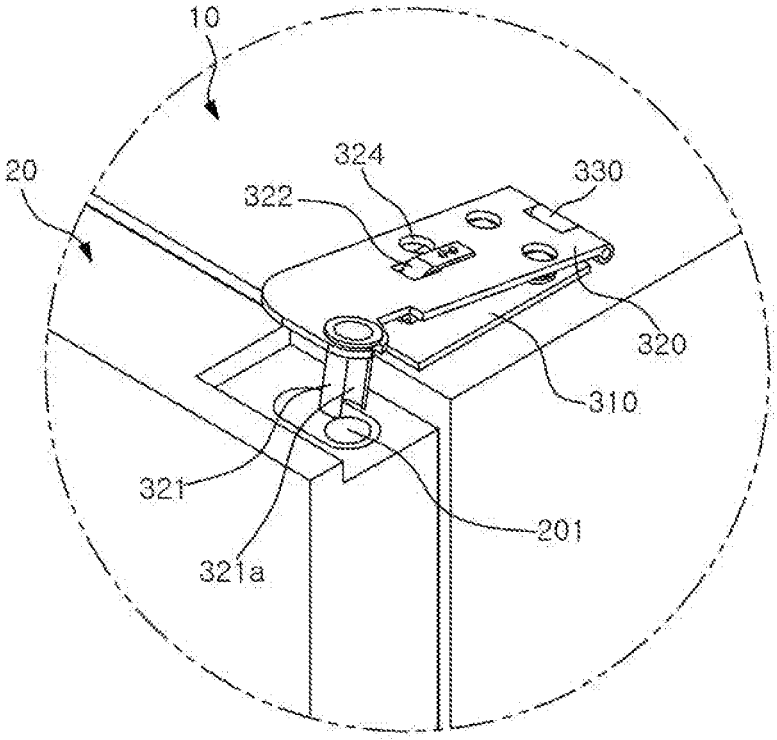
FIG. 5 is a diagram showing the hinge is coupled to the door shown in FIG. 1.
Figure 6:
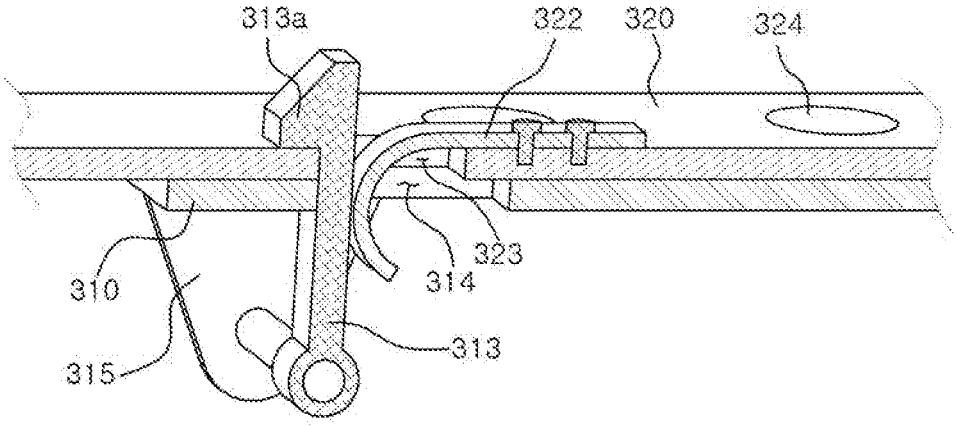
FIG. 6 is a cross-sectional view showing the upper hinge plate coupled to the lower hinge plate.

FIG. 1 is a perspective view of a refrigerator according to an embodiment of the present disclosure. FIG. 2 is a perspective view of a hinge as shown in FIG. 1. FIG. 3 is an enlarged view of a portion A in FIG. 1. FIG. 4 is a diagram showing the hinge separated from the door shown in FIG. 1. FIG. 5 is a diagram showing the hinge coupled to the door as shown in FIG. 1. FIG. 6 is a cross-sectional view showing the upper hinge plate coupled to the lower hinge plate.

Referring to FIGS. 1 to 6, the refrigerator 1 according to an embodiment of the present disclosure is for keeping food in a low-temperature state. The refrigerator 1 may include a main body 10 having a storage space for food, a rotatable door 20 on the front of the main body 10 and selectively shielding and opening the storage space, and a hinge 30 rotatably fixing the door 20 to the main body 10.

In one embodiment, a top-mount type refrigerator 1, in which a freezing room is over a cold room, is illustrated, but the spirit of the present disclosure is not limited thereto. The present disclosure may also be applied to the bottom freezer type and the side-by-side type of refrigerators.

Specifically, the main body 10 includes one or more food storage spaces and has an openable front that can be selectively shielded or closed by the door 20. In this case, the front of the main body 10 may mean an open surface shieldable by the door 20. Furthermore, the main body 10 may include a cool space and a freezing space, depending on the temperature of the space. In this case, both the cool space and the freezing space may have openable fronts that may be selectively shielded or closed by separate doors 20.

The doors 20 selectively shield the storage spaces of the main body 10, and one or more doors may be coupled to the main body 10. Specifically, the doors 20 are rotatably attached to one side of the main body 10, and a handle capable of being held by a user may be on the front of the door 20 (e.g., on the other side of the door 20 from the location of rotatable attachment). Furthermore, a plurality of baskets (not shown) capable of receiving food may be on the back of either or both of the doors 20.

The main body 10 and the door 20 may be coupled by the hinge 30. Part of the hinge 30 is fixed to the main body 10, and another part thereof is fixed to the door 20, so that rotatable movement of the door 20 can be implemented.

Specifically, the hinge 30 couples the door 20 so that the door is horizontally rotatable. The hinge 30 may include a lower hinge plate 310 coupled to the main body 10, an upper hinge plate 320 connected to the lower hinge plate 310 and coupled to the door 20, and a connection part 330 rotatably connecting the upper hinge plate 320 and the lower hinge plate 310 (i.e., in such a manner that the upper hinge plate 320 may rotate up and down with respect to the lower hinge plate 310).

The lower hinge plate 310 is coupled to the top (e.g., an uppermost surface) of the main body 10 on one side. The lower hinge plate 310 may include one or more fastening holes 311, one or more fastening members 312 coupled or connected to the main body 10 through the fastening hole(s) 311, a hitch member 313 that can be coupled to the upper hinge plate 320, a hitch member through-hole 314 through which the hitch member 313 can penetrate, and a hitch member fixing part 315 fixing the hitch member 313 to the lower hinge plate 310.

The lower hinge plate 310 may have a plate shape and may include one or more fastening holes 311. Furthermore, one or more fastening members 312 may penetrate through the one or more fastening holes 311, respectively. In one embodiment, the lower hinge plate 310 is illustrated as including three fastening holes 311 and three fastening members 312, but the number of fastening holes 311 is not limited to 3. For example, the lower hinge plate 310 may include two fastening holes 311 and two fastening members 312, four fastening holes 311 and four fastening members 312, etc.

The number of fastening members 312 may correspond to the number of fastening holes 311, and may be coupled to the main body 10 through the fastening holes 311. In this case, the fastening member 312 may be or comprise one or more bolts, and the hinge 30 may be fixed to one side of the main body 10 by the fastening member(s) 312.

The lower hinge plate 310 may include the hitch member 313, which can be coupled to the upper hinge plate 320. The hitch member 313 may be or comprise a hook extending vertically and having a protrusion 313*a* at an end and/or on one side thereof. In this case, the protrusion 313*a* engages with the upper hinge plate 320, so the upper hinge plate 320 is hooked to the lower hinge plate 310. The coupling of the hitch member 313 and the upper hinge plate 320 is described in detail later.

The hitch member 313 may penetrate the hitch member through-hole 314 (e.g., in a particular state of the hinge 30). The hitch member through-hole 314 may be on one side of the fastening hole(s) 311, and may have a width corresponding to (e.g., slightly larger than) the width of the hitch member 313. For example, a vertically-extending portion of the hitch member 313 may have a plate shape. The hitch member through-hole 314 may have a rectangular form. The hitch member through-hole 314 may have a length corresponding to (e.g., slightly greater than) the thickness of the hitch member 313, the length to which the projection or protrusion 313*a* extends away from the plate portion of the hitch member 313, and the horizontal length of the part of the elastic member 322 that extends through the hitch member through-hole 314. Accordingly, the vertically-extending portion of the hitch member 313 may penetrate the hitch member through-hole 314.

The hitch member 313 that penetrates the hitch member through-hole 314 may be rotatably fixed to the lower hinge plate 310 by the hitch member fixing part 315. The hitch member fixing part 315 extends from the plate portion of the lower hinge plate 310 away from the upper hinge plate 320, and the hitch member 313 may be coupled to one or two sides of the hitch member fixing part 315. In this case, the end of the hitch member 313 opposite the protrusion 313*a* and two sides of the hitch member fixing part 315 may be coupled (e.g., through an axle or shaft; see, e.g., FIG. 2). The rotation center of the hitch member 313 (e.g., the axle or shaft) may be under the lower hinge plate 310.

When the lower hinge plate 310 is coupled to the main body 10 by the fastening member(s) 312, the main body 10 may include a groove or depression (not shown), and the hitch member 313 and the hitch member fixing part 315 may be placed in the groove or depression. The groove or depression (not shown) may correspond to (e.g., be slightly larger than) the size of the hitch member fixing part 315. Referring to FIG. 6, in one embodiment, the hitch member fixing part 315 is illustrated as having an inverse trigonometric (e.g., substantially triangular) shape, and an end of the hitch member 313 is illustrated as being coupled to a vertex and/or lower side or end of the hitch member fixing part 315. However, the hitch member fixing part 315 and the hitch member 313 are not limited to such shapes and/or arrangements. For example, the hitch member fixing part 315 may have a square, rectangular or hemispherical form or shape, and the hitch member 313 may be coupled to the center, a corner, and/or a lower side or end of the hitch member fixing part 315. Accordingly, the shape and/or dimensions of the groove or depression (not shown) in the main body 10 may depend on the shape and/or dimensions of the hitch member fixing part 315.

The lower hinge plate 310 may be coupled to the upper hinge plate 320. The upper hinge plate 320 is coupled to the door 20. The upper hinge plate 320 may include a pivot 321 configured to fit into the door 20, an elastic member 322 fixing the hitch member 313 to the upper hinge plate 320 through an elastic force, a hitch hole 323 through which the elastic member 322 passes, and one or more fastening member through-holes 324 configured to expose the fastening member(s) 312.

The upper hinge plate 320 may have a plate shape having the same width as the lower hinge plate 310, but may have a greater length than the lower hinge plate 310. Specifically, the upper hinge plate 320 and the lower hinge plate 310 may have the same width, and one end of each of the two members (e.g., farthest away from the door 20) may be coupled. When the lower hinge plate 310 is coupled to the main body 10, the upper hinge plate 320 may move rotatably around the one end that is coupled to the lower hinge plate 310. In this case, the upper hinge plate 320 may extend in front of the main body 10, and the end of the upper hinge plate 320 containing the pivot 321 may extend in front of the main body 10 by a distance sufficient to overlap with the door 20 (e.g., by 50-100% of the width of the door 20 and any gasket on the inner surface thereof). Accordingly, the pivot 321 on the upper hinge plate 320 in front of the main body 10 may be coupled to the door 20.

The pivot 321 is configured to fit into the top of the door 20 on one side and/or end thereof, and may be at the end of the upper hinge plate 320 extending in front of the main body 10. In this case, the pivot 321 may have a structure extending from the upper hinge plate 320 beyond the lower hinge plate 310 when the upper hinge plate 320 comes into contact with the lower hinge plate 310. The upper hinge plate 320 may be substantially cylindrical and/or have a pipe form, and may be hollow (e.g., be empty inside). The pivot 321 may fit into the pivot insertion unit 201 of the door 20. To this end, the pivot insertion unit 201 may have a size corresponding to the diameter and length of the pivot 321. In this case, the door 20 moves rotatably around the pivot 321, so the storage space of the main body 10 may be selectively opened and closed or shielded.

Specifically, after the lower hinge plate 310 is coupled to the main body 10, the upper hinge plate 320 may move rotatably around the one end thereof coupled to the lower hinge plate 310. In this case, in a first state in which the upper hinge plate 320 and the lower hinge plate 310 overlap or come into full contact due to the rotatable movement of the upper hinge plate 320, the pivot 321 may extend to in front of the main body 10 and may be placed into the pivot insertion unit 201 of the door 20.

The pivot 321 may have a cylinder or pipe form having one side (e.g., along a length thereof) cut off or missing, to prevent interference or difficulty when placing it in the pivot insertion unit 201. A cutoff part or opening 321*a* is in along the pivot 321 having a cylindrical form, and may provide a space into which the pivot 321 contracts or compresses when the pivot 321 is placed into the pivot insertion unit 201. In this case, the pivot 321 may deform elastically. Accordingly, when the pivot 321 is inserted into the pivot insertion unit 201, it may be elastically deformed to couple to the pivot insertion unit 201.

The upper hinge plate 320 may include the elastic member 322 and the hitch hole 323. The elastic member 322 functions to fix the hitch member 313 to the upper hinge plate 320 through an elastic force. The elastic member 322 may have one side and/or end fixed to the top or uppermost surface of the upper hinge plate 320 through separate fastening means, and may have another (e.g., opposite) side and/or end with a specific curvature that penetrates the hitch hole 323. The curvature of the elastic member 322 is configured to provide the elastic force when the hitch member 313 is presses against it. In this case, the hitch hole 323 corresponds to (e.g., has the same or similar shape and/or dimensions as) the hitch member through-hole 314. Accordingly, when the front of the lower hinge plate 310 and the front of the upper hinge plate 320 come into contact with each other, the hitch member 313 may penetrate the hitch hole 323.

Specifically, in the first state in which the upper hinge plate 320 overlaps (e.g., fully contacts) the lower hinge plate 310 (see, e.g., FIG. 3), the hitch hole 323 and the hitch member through-hole 314 in corresponding locations may communicate with each other or overlap. Accordingly, the hitch member 313 may penetrate the hitch hole 323 in addition to the hitch member through-hole 314 while the curved side or end of the elastic member 322 contacts the hitch member 313. The hitch member 313 that has penetrated the hitch hole 323 may be configured so that the protrusion 313*a* engages with (e.g., contacts) the uppermost surface of the upper hinge plate 320. In this case, in the first state, the curved side or end of the elastic member 322 may press the hitch member 313 against the edge or circumference surface of the hitch hole 323 so that the hitch member 313 does not move or pitch. That is, the lower hinge plate 310 and the upper hinge plate 320 may be hooked to each other in such a state.

Furthermore, as the lower hinge plate 310 and the main body 10 are coupled, the pivot 321 is placed into the pivot insertion unit 201, and the upper hinge plate 320 and the door 20 are coupled. Accordingly, the locations of the main body 10 and the door 20 may also be fixed by coupling the upper hinge plate 320 to the lower hinge plate 310.

The separation of the main body 10 and the door 20, in addition to the secure attachment of the door 20 to the main body 10, may also be performed by manipulation of the hitch member 313 and the elastic member 322. Specifically, in order to separate the door 20 from the main body 10, the hitch member 313 may be separated from the upper hinge plate 320. Specifically, a user may push the hitch member 313 toward the elastic member 322, because the hitch member 313 moves rotatably around the portion (e.g., the axle or shaft) of the hitch member fixing part 315 to which it is coupled. The elastic member 322 compresses (e.g., moves to the side opposite the hitch member 313) in response to a change in the location of the hitch member 313. Accordingly, a user may push the protrusion 313*a* of the hitch member 313 over the hitch hole 323. That is, when the hitch member 313 is pressed, the upper hinge plate 320 may move and/or rotate again, releasing the upper hinge plate 320 and separating the pivot 321 of the upper hinge plate 320 from the pivot insertion unit 201 of the door 20. That is, in a second state in which the upper hinge plate 320 moves rotatably and thus the free end moves away from the lower hinge plate 310, the main body 10 and the door 20 may be separated.

The fastening member(s) 312 for securing the lower hinge plate 310 to the main body 10 may extend above the fastening hole 311. In this case, the extending portion of the fastening member 312 may hinder the contact of the lower hinge plate 310 and the upper hinge plate 320. Accordingly, the upper hinge plate 320 may include the fastening member through-hole(s) 324 through which the extending portion of the fastening member(s) 312 penetrates so that contact of the upper hinge plate 320 with the lower hinge plate 310 is facilitated. The number of fastening member through-holes 324 may correspond to the number of fastening members 312. The fastening member through-hole(s) 324 may have a greater diameter than the extending portion of the fastening member 312 so that the fastening member 312 penetrates or extends into the fastening member through-hole 324. Accordingly, when the upper hinge plate 320 moves and/or rotates and comes into plate-to-plate contact with the lower hinge plate 310, the extending fastening member 312 penetrates the fastening member through-hole 324, so the upper hinge plate 320 and the lower hinge plate 310 can easily come into contact with each other.

The lower hinge plate 310 and the upper hinge plate 320 may be connected, and the upper hinge plate 320 may rotate, through the connection part 330. The connection part 330 connects one end of the lower hinge plate 310 and one end of the upper hinge plate 320, and may be or comprise a shaft that supports the rotatable movement of the upper hinge plate 320. Specifically, the connection part 330 may be at the end or side of the lower hinge plate 310 farthest from the door 20. In this case, the connection part 330 may be separate from the lower hinge plate 310 and the upper hinge plate 320, and the connection part 330 may be coupled to the lower hinge plate 310 and/or the upper hinge plate 320 through fastening means, but the connection part 330 is not limited to such a configuration. For example, the connection part 330 may be integrated with the lower hinge plate 310 and coupled to the upper hinge plate 320 through a separate pin.

Operations and effects of the refrigerator 1 and the hinge 30 for a door of a refrigerator according to embodiments of the present disclosure are described below.

First, the lower hinge plate 310 of the hinge 30 may be fixed to the top of the main body 10 at one side of the refrigerator 1. In this case, the lower hinge plate 310 may be fixed to the main body 10 through the fastening member(s) 312. The groove or depression (not shown) having a size corresponding to the hitch member 313 and the hitch member fixing part 315 is on the one side at or in the top of the main body 10, and thus the hitch member 313 penetrating the hitch member through-hole 314 and the hitch member fixing part 315 fixing the hitch member 313 to the lower hinge plate 310 may be located on the one side at or in the top of the main body 10.

The upper hinge plate 320 may be connected to the lower hinge plate 310 through the connection part 330. In this case, the connection part 330 enables the upper hinge plate 320 to rotate. Accordingly, the upper hinge plate 320 and the lower hinge plate 310 have a first state in which they overlap (e.g., are in plate-to-plate contact).

When the upper hinge plate 320 overlaps the lower hinge plate 310, the hitch member 313 of the lower hinge plate 310 penetrates the hitch hole 323 of the upper hinge plate 320, and the protrusion 313*a* of the hitch member 313 may engage with the uppermost surface and/or back of the upper hinge plate 320. At this time, the elastic member 322 pushes the hitch member 313 towards the front of the main body 10, so the hitch member 313 may be fixed, and the upper hinge plate 320 and the lower hinge plate 310 may be coupled, but the present invention is not limited to such a configuration.

Furthermore, when the upper hinge plate 320 and the lower hinge plate 310 are coupled, the upper hinge plate 320, having a greater length than the lower hinge plate 310, may extend in front of the main body 10. Accordingly, the pivot 321 of the upper hinge plate 320 having an elastic property may extend in front of the main body 10. The pivot 321 may be inserted into the pivot insertion unit 201 of the door 20. At this time, interference between the pivot 321 and the pivot insertion unit 201 can be reduced or prevented because of the cutoff part or opening 321*a*. Accordingly, the upper hinge plate 320 can be easily coupled to the door 20.

In order to separate the door 20 from the main body 10, the hitch member 313 may be separated from the upper hinge plate 320. Specifically, a user may push the hitch member 313 toward the elastic member 322. The elastic member 322 may move or be compressed to the side or end of the hitch hole 323 opposite the hitch member 313 through an elastic force. Accordingly, the hitch member 313 may pass through the hitch hole 323 and be separated from the elastic member 322 by rotating the upper hinge plate 320 away from the lower hinge plate 310. That is, the upper hinge plate 320 can be separated from the lower hinge plate 310.

When the upper hinge plate 320 and the lower hinge plate 310 are separated, the pivot 321 of the upper hinge plate 320 may be separated or removed from the pivot insertion unit 201 of the door 20. That is, the upper hinge plate 320 and the door 20 can be separated, and the upper hinge plate 320 is in the second state in which it is isolated from the lower hinge plate 310. In this case, even when the door 20 is separated, the lower hinge plate 310 can maintain its regular position (e.g., fixed to the top of the main body 10) without being separated from the main body 10. Accordingly, there is an effect in that the door 20 can be always fixed to its regular position, even after the door 20 is removed from and reconnected to the main body 10.

Furthermore, the upper hinge plate 320 and the lower hinge plate 310 are fixed and separated by the hitch member 313 and the elastic member 322, and the upper hinge plate 320 and the door 20 are coupled and separated by the insertion and removal of the pivot 321. Accordingly, there is an advantage in that the door 20 can be separated from the main body 10 without a separate tool.

In accordance with the refrigerator and the hinge for the door of the refrigerator according to embodiments of the present disclosure, there is an effect in that the door can be fixed at its regular position even upon reassembly.

Furthermore, there is an advantage in that the door can be separated and re-attached without a separate tool.

The refrigerator and the hinge for a door of the refrigerator according to embodiments of the present disclosure have been described, but the above description is merely illustrative of the technical idea of the present disclosure and various changes and modifications may be made without departing from the essential characteristics of the present disclosure. Therefore, the embodiments described in the present disclosure are not intended to limit the scope of the present disclosure, but are intended to illustrate and not limit the scope of the present disclosure. The scope of protection of the present disclosure should be construed according to the following claims, and all technical ideas which are equivalent or equivalent thereto should be interpreted as being included in the scope of the present disclosure.

What is claimed is:

1. A refrigerator, comprising:

a main body having a storage space capable of storing food;

a door selectively opening and shielding or closing the storage space of the main body; and a hinge rotatably fixing the door to the main body, wherein the hinge comprises:

a lower hinge plate fixed to the main body, a rotatable hitch member through the lower hinge plate; and an upper hinge plate having an end and/or side rotatably coupled to the lower hinge plate and a pivot for the door, wherein the upper hinge plate overlaps the lower hinge plate and is coupled to the lower hinge plate by the hitch member in a first state and is isolated or separated from the lower hinge plate in a second state, and the upper hinge plate comprises a hitch hole through which the hitch member can penetrate and an elastic member configured to maintain the first state, wherein, in the first state, the hitch member is movable within the hitch hole, and the elastic member applies a force to the hitch member.

2. The refrigerator of claim 1, wherein:

the door comprises a pivot insertion unit having a size corresponding to a size of the pivot, the pivot is configured to fit into the pivot insertion unit, the upper hinge plate is coupled to the door, and the door moves rotatably around the pivot.

3. The refrigerator of claim 2, wherein the pivot is elastically deformable and is elastically deformed when the pivot is in the pivot insertion unit.

4. The refrigerator of claim 3, wherein the pivot has a cylindrical or pipe form with an opening or cut-off region along a length thereof.

5. The refrigerator of claim 1, wherein:

one side or end of the elastic member is fixed to a top or uppermost surface of the upper hinge plate, and another side or end of the elastic member has a specific curvature, penetrates the hitch hole, and applies the force to the hitch member when the hitch member passes through the hitch hole so that the hitch member engages the upper hinge plate in the first state.

6. The refrigerator of claim 1, wherein:

the hitch member is rotatably fixed to a hitch member fixing part extending downward from the lower hinge plate, and the main body includes a groove or depression configured to receive the hitch member fixing part.

7. The refrigerator of claim 1, wherein:

the lower hinge plate is coupled to the main body with one or more bolts, and the upper hinge plate comprises one or more fastening member through-holes configured to expose the one or more bolts in the first state.

8. The refrigerator of claim 1, wherein:

the pivot has a cylindrical or pipe form with an opening or cut-off region along a length thereof to enable elastic deformation, and the pivot is elastically deformed when the pivot is in or inserted into a pivot insertion unit in the door.

9. The refrigerator of claim 1, wherein the hitch member comprises a hook configured to hook the upper hinge plate with or to the lower hinge plate.

10. A hinge for a door of a refrigerator, comprising:

a lower hinge plate that can be fastened to a main body of the refrigerator and comprising an upward extending hitch member; and an upper hinge plate rotatably coupled to an end and/or side of the lower hinge plate, comprising a hitch hole through which the hitch member couples the lower hinge plate to the upper hinge plate, the hitch member is movable within the hitch hole, a pivot configured to be inserted into the door and enabling the door to rotate, and an elastic member configured to maintain the hitch member in an engaged state, the upper hinge plate being closely attached to the lower hinge plate when the hitch member couples the lower hinge plate to the upper hinge plate, and the hitch member and the elastic member may be configured to enable the hitch member to disengage from the hitch hole and/or the upper hinge plate.

11. The hinge of claim 10, wherein:

the hitch member is rotatably fixed to a hitch member fixing part extending downward from the lower hinge plate, and a rotation axis of the hitch member is below the lower hinge plate.

12. The hinge of claim 10, wherein:

one side or end of the elastic member is fixed to a top of the upper hinge plate, another side or end of the elastic member has a specific curvature, penetrates the hitch hole, and applies a force to the hitch member when the hitch member passes through the hitch hole so that the hitch member engages the upper hinge plate.

13. The hinge of claim 10, wherein the upper hinge plate is rotatably connected to an end or side of the lower hinge plate farthest from the pivot.

14. The hinge of claim 10, wherein the hitch member and the elastic member enable the hitch member to disengage from the hitch hole and/or the upper hinge plate when the upper hinge plate rotates away from the lower hinge plate.

15. The hinge of claim 10, wherein the pivot is cylindrical, and has an opening or a cut-off region along the length thereof.

16. A hinge for a door of a refrigerator, comprising:

a lower hinge plate that can be fastened to a main body of the refrigerator and comprising an upward extending hitch member; and an upper hinge plate rotatably coupled to an end and/or side of the lower hinge plate, comprising a hitch hole through which the hitch member couples the lower hinge plate to the upper hinge plate, an elastic member having one side or end fixed to a top of the upper hinge plate, and a pivot configured to be inserted into the door and enabling the door to rotate, the upper hinge plate being closely attached to the lower hinge plate when the hitch member couples the lower hinge plate to the upper hinge plate, wherein the elastic member has another side or end that has a specific curvature, penetrates the hitch hole, and applies a force to the hitch member when the hitch member passes through the hitch hole so that the hitch member engages the upper hinge plate.

17. The hinge of claim 16, wherein the hitch member comprises a hook configured to hook the upper hinge plate with or to the lower hinge plate.

18. The hinge of claim 16, wherein the hitch member and the elastic member enable the hitch member to disengage from the hitch hole and/or the upper hinge plate when the upper hinge plate rotates away from the lower hinge plate.

19. The hinge of claim 16, wherein the pivot is cylindrical and has an opening or cut-off region along a length thereof.

* * * * *